US009307794B1

(12) United States Patent
Rumsey

(10) Patent No.: US 9,307,794 B1
(45) Date of Patent: Apr. 12, 2016

(54) BODY SUPPORT AND SCULPTING GARMENT

(71) Applicant: Frances Crofut Rumsey, Saratoga, CA (US)

(72) Inventor: Frances Crofut Rumsey, Saratoga, CA (US)

( * ) Notice: Subject to any disclaimer, the term of this patent is extended or adjusted under 35 U.S.C. 154(b) by 0 days.

(21) Appl. No.: 14/752,506

(22) Filed: Jun. 26, 2015

(51) Int. Cl.
*A41D 1/08* (2006.01)
*A41D 1/14* (2006.01)
*A41D 1/06* (2006.01)

(52) U.S. Cl.
CPC *A41D 1/067* (2013.01); *A41D 1/08* (2013.01); *A41D 1/14* (2013.01)

(58) Field of Classification Search
CPC .. A41B 2300/20; A41B 2400/38; A41D 1/06; A41D 1/14
USPC ..... 450/98, 99, 109, 114–117, 122, 123, 450/131, 132; 2/69, 227, 236, 237, 220, 2/221; 66/169 R, 170, 171, 172 E, 66/175–177
See application file for complete search history.

(56) References Cited

U.S. PATENT DOCUMENTS

| | | | | |
|---|---|---|---|---|
| 4,069,513 | A * | 1/1978 | Shiller | A41D 1/14 2/212 |
| 5,613,893 | A | 3/1997 | Zagame | |
| 5,915,531 | A * | 6/1999 | Hilpert | A41D 13/0017 2/109 |
| 6,035,448 | A * | 3/2000 | Thomson | A41D 1/06 2/227 |
| 6,161,222 | A | 12/2000 | Strickland et al. | |
| 7,882,574 | B2 | 2/2011 | Arsenault et al. | |
| 2007/0118954 | A1* | 5/2007 | Lee | A41C 1/003 2/69 |
| 2009/0083594 | A1* | 3/2009 | Chelstrom | G01R 31/318594 714/727 |

* cited by examiner

*Primary Examiner* — Gloria Hale
(74) *Attorney, Agent, or Firm* — Crossley & Stevenson IP Law

(57) ABSTRACT

A body support and sculpting garment including a garment having a front panel configured to cover a wearer's stomach and a wearer's hips, and a rear panel configured to cover a wearer's buttocks, a first support portion seamlessly disposed within the rear panel of the garment along a contour of the wearer's buttocks, and a substantially triangulated second support portion seamlessly disposed within the rear panel of the garment along a top side of the contour. The first support portion and the second support are double weave compression fabric and are configured to support a wearer's back and hips and sculpt a wearer's buttocks.

8 Claims, 3 Drawing Sheets

BODY SUPPORT AND SCULPTING GARMENT

BACKGROUND OF THE INVENTION

Various types of body supporting and body sculpting garments are known in the prior art. However, what has been needed is a body support and sculpting garment including a garment having a front panel configured to cover a wearer's stomach and a wearer's hips, and a rear panel configured to cover a wearer's buttocks. What has been further needed is a first support portion seamlessly disposed within the rear panel of the garment along a contour of the wearer's buttocks, and a substantially triangulated second support portion seamlessly disposed within the rear panel of the garment along a top side of the contour. Lastly, what has been needed is for the first support portion and the second support portion to be double weave compression fabric in order to both support a wearer's back and hips and sculpt a wearer's buttocks.

The contouring and lifting nature of the first support portion, the second support portion, and an optional third support portion provides a wearer with additional support to his back and hips. Although the body support and sculpting garment can be worn at any point throughout the day, the garment is particularly well suited for exercise in order to alleviate pain and pressure in the wearer's back and hips. The body support and sculpting garment can optionally be a pair of shorts, a pair of pants, and a skirt. The double weave compression fabric of the first support portion, the second support portion, and the optional third support portion can optionally be produced with three levels of varying thickness for a light, medium, and maximum level of support.

FIELD OF THE INVENTION

The present invention relates to body supporting and body sculpting garments, and more particularly, to a body support and sculpting garment.

SUMMARY OF THE INVENTION

The general purpose of the present body support and sculpting garment, described subsequently in greater detail, is to provide a garment which has many novel features that result in a body support and sculpting garment which is not anticipated, rendered obvious, suggested, or even implied by prior art, either alone or in combination thereof.

To accomplish this, the present body support and sculpting garment includes a garment, a first support portion, and a substantially triangulated second support portion. The garment is optionally one of a pair of pants, a pair of shorts, and a skirt. The garment has a front panel configured to cover a wearer's stomach and a wearer's hips, and a rear panel seamlessly joined to the front panel. Each of the front panel and the rear panel have a right end and a left end. The rear panel is configured to cover a wearer's buttocks. The first support portion is seamlessly disposed within the rear panel of the garment along a contour of the wearer's buttocks from a top right side of the contour to a top left side of the contour. The first support portion has a top right end and a top left end. The substantially triangulated second support portion is seamlessly disposed within the rear panel of the garment along a top side of the contour. The second support portion has an apex, a right edge, and a left edge. The right edge of the second support portion is joined to the top right end of the first support portion, and the left edge of the second support portion is joined to the top left end of the first support portion.

The first support portion and the second support portion are double weave compression fabric. The first support portion and the second support portion are configured to both support a wearer's back and the wearer's hips, and sculpt a wearer's buttocks.

The body support and sculpting garment optionally includes a third support portion seamlessly disposed within the front panel of the garment from the right end of the front panel to the left end of the front panel. The third support portion is continuously disposed atop the wearer's stomach from a wearer's right hip to a wearer's left hip. The third support portion is double weave compression fabric and is configured to sculpt the wearer's stomach and support the wearer's hips.

Thus has been broadly outlined the more important features of the present body support and sculpting garment so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
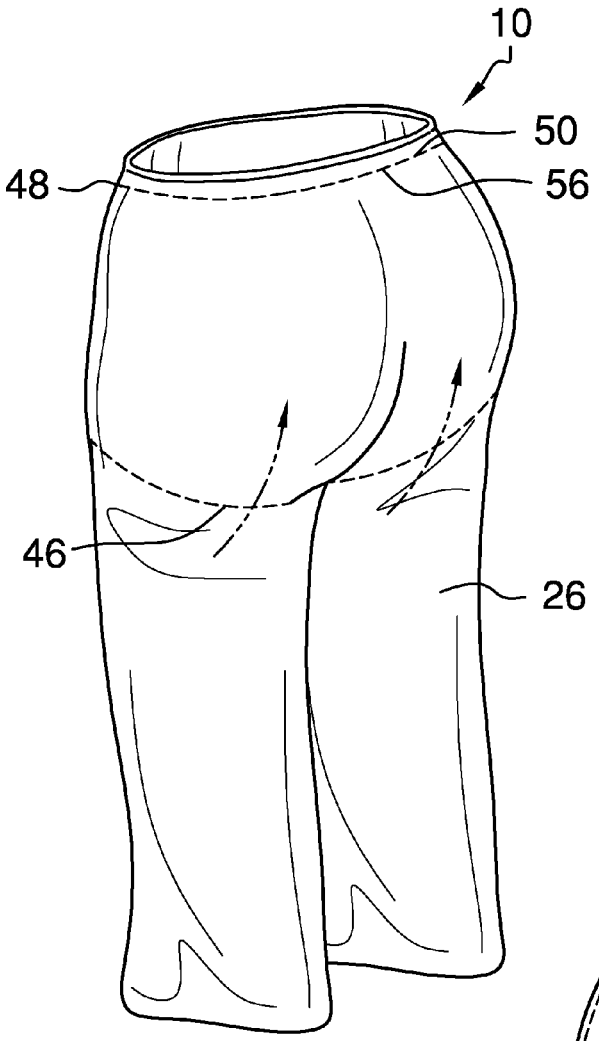
FIG. 1 is a rear isometric view.
Figure 2:
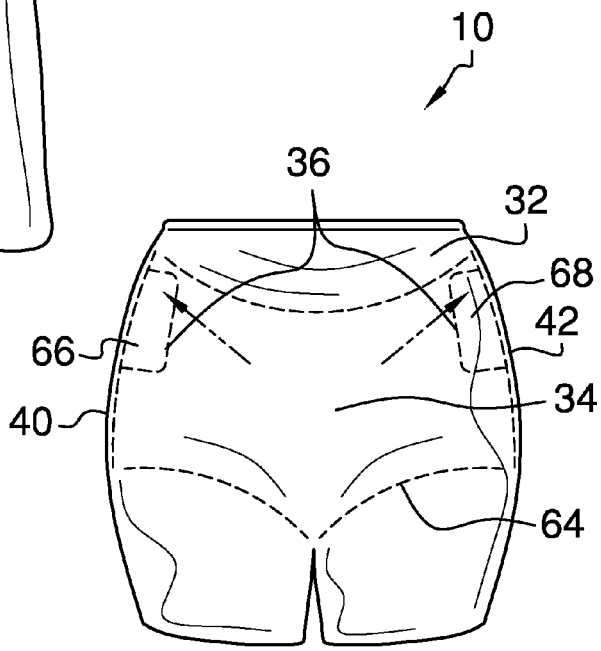
FIG. 2 is a front elevation view.
Figure 3:
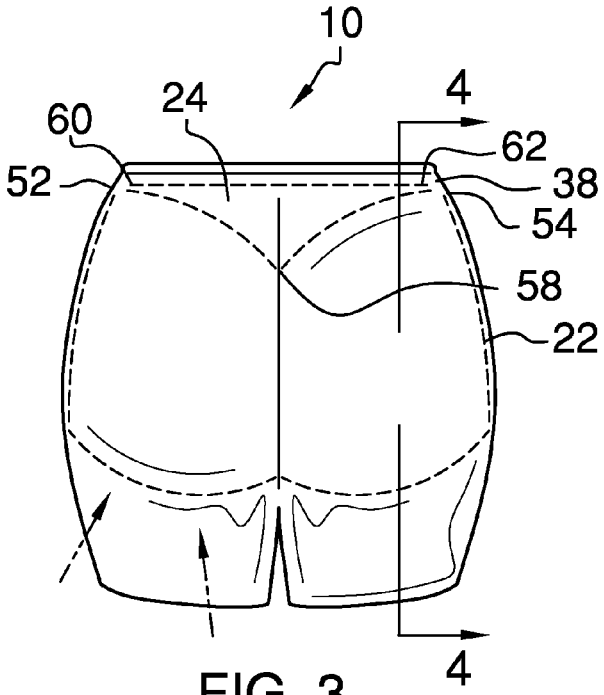
FIG. 3 is a rear elevation view.
Figure 4:
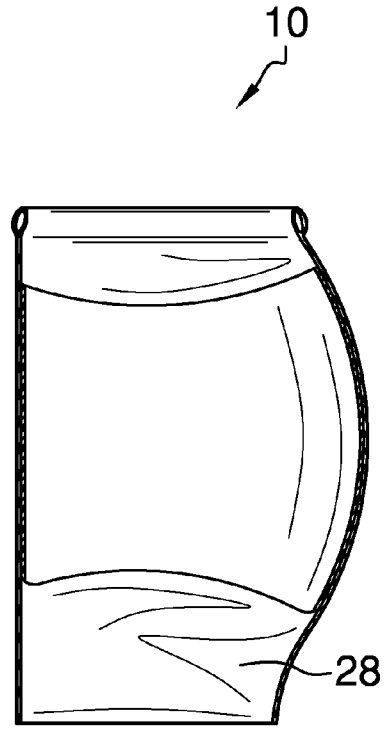
FIG. 4 is a cross-sectional view taken along line 4-4 of FIG. 3.
Figure 5:
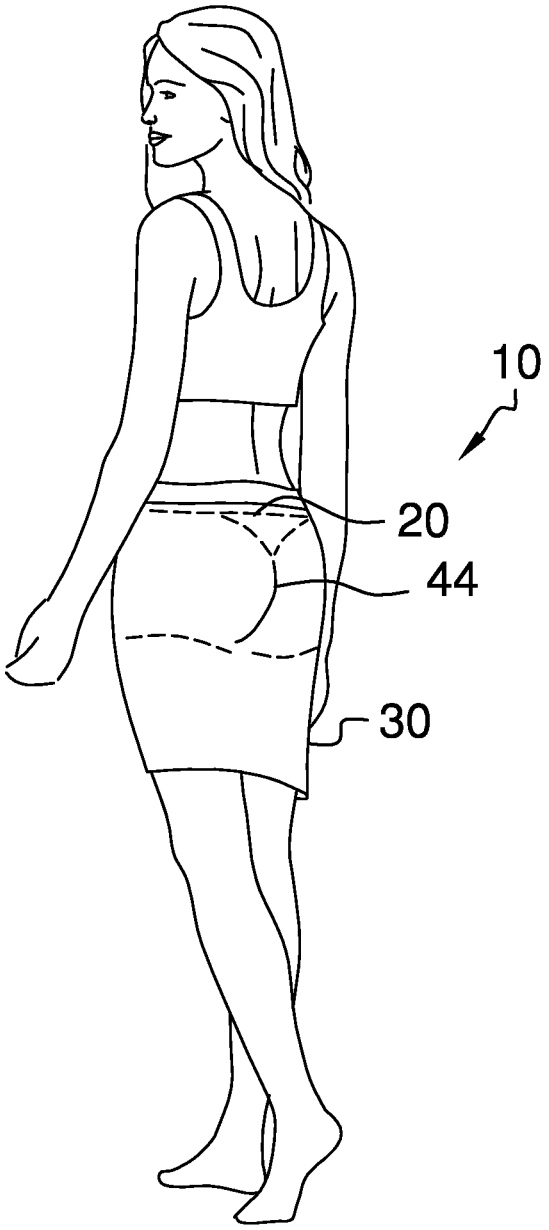
FIG. 5 is an in-use view.

With reference now to the drawings, and in particular FIGS. 1 through 5 thereof, an example of the instant body support and sculpting garment employing the principles and concepts of the present body support and sculpting garment and generally designated by the reference number 10 will be described.

Referring to FIGS. 1 through 5 the present body support and sculpting garment 10 is illustrated. The body support and sculpting garment 10 includes a garment 20, a first support portion 22, and a substantially triangulated second support portion 24. The garment 20 is optionally one of a pair of pants 26, a pair of shorts 28, and a skirt 30. The garment 20 has a front panel 32 configured to cover a wearer's stomach 34 and a wearer's hips 36, and a rear panel 38 seamlessly joined to the front panel 32. Each of the front panel 32 and the rear panel 38 have a right end 40 and a left end 42. The rear panel 38 is configured to cover a wearer's buttocks 44. The first support portion 22 is seamlessly disposed within the rear panel 38 of the garment 20 along a contour 46 of the wearer's buttocks 44 from a top right side 48 of the contour 46 to a top left side 50 of the contour 46. The first support portion 22 has a top right end 52 and a top left end 54. The substantially triangulated second support portion 24 is seamlessly disposed within the rear panel 38 of the garment 20 atop the first support portion 22 and along a top side 56 of the contour 46. The second support portion 24 has an apex 58, a right edge 60, and a left edge 62. The right edge 60 of the second support portion 24 is joined to the top right end 52 of the first support portion 22, and the left edge 62 of the second support portion 24 is joined to the top left end 54 of the first support portion 22. The first support portion 22 and the second support portion 24 are double weave compression fabric.

The body support and sculpting garment 10 optionally includes a third support portion 64 seamlessly disposed within the front panel 32 of the garment 20 from the right end 40 of the front panel 32 to the left end 42 of the front panel 32. The third support portion 64 is continuously disposed atop the wearer's stomach 34 from a wearer's right hip 66 to a wearer's left hip 68. The third support portion 64 is double weave compression fabric and is configured to sculpt the wearer's stomach 34 and support the wearer's hips 36.

What is claimed is:

1. A body support and sculpting garment comprising:

a garment having a front panel configured to cover a wearer's stomach and a wearer's hips, and a rear panel seamlessly joined to the front panel, wherein each of the front panel and the rear panel have a right end and a left end, wherein the rear panel is configured to cover a wearer's buttocks;

a first support portion seamlessly disposed within the garment rear panel along a contour of the wearer's buttocks from a top right side of the contour to a top left side of the contour, wherein the first support portion has a top right end and a top left end; and a substantially triangulated second support portion seamlessly disposed within the garment rear panel atop the first support portion and along a top side of the contour, the second support portion having an apex, a right edge, and a left edge, wherein the second support portion right edge is joined to the first support portion top right end, and the second support portion left edge is joined to the first support portion top left end;

wherein the first support portion and the second support portion are double weave compression fabric;

wherein the first support portion and the second support portion are configured to both support a wearer's back and the wearer's hips, and sculpt a wearer's buttocks.

2. The body support and sculpting garment of claim 1 further comprising:

a third support portion seamlessly disposed within the garment front panel from the front panel right end to the front panel left end, wherein the third support portion is continuously disposed atop the wearer's stomach from a wearer's right hip to a wearer's left hip;

wherein the third support portion is double weave compression fabric;

wherein the third support portion is configured to sculpt the wearer's stomach and support the wearer's hips.

3. The body support and sculpting garment of claim 1 wherein the garment is a pair of shorts.

4. The body support and sculpting garment of claim 2 wherein the garment is a pair of shorts.

5. The body support and sculpting garment of claim 1 wherein the garment is a pair of pants.

6. The body support and sculpting garment of claim 2 wherein the garment is a pair of pants.

7. The body support and sculpting garment of claim 1 wherein the garment is a skirt.

8. The body support and sculpting garment of claim 2 wherein the garment is a skirt.

* * * * *